US006217431B1

(12) United States Patent
Brinkmann

(10) Patent No.: US 6,217,431 B1
(45) Date of Patent: Apr. 17, 2001

(54) SANDING BRUSH ASSEMBLY

(75) Inventor: Manfred Brinkmann, Detmold (DE)

(73) Assignee: Arminius-Schleifmittel GmbH, Detmold (DE)

( * ) Notice: Subject to any disclaimer, the term of this patent is extended or adjusted under 35 U.S.C. 154(b) by 0 days.

(21) Appl. No.: 09/266,333

(22) Filed: Mar. 11, 1999

(30) Foreign Application Priority Data

Mar. 19, 1998 (DE) ..... 298 04 936 U

(51) Int. Cl.[7] ..... B24B 9/02

(52) U.S. Cl. ..... 451/464; 451/466; 451/469; 451/490

(58) Field of Search ..... 451/464, 466, 451/469, 490

(56) References Cited

U.S. PATENT DOCUMENTS 2,423,992 * 7/1947 Nordgren et al. ..... 451/466
2,443,413 * 6/1948 Bonkowski ..... 451/466
2,599,961 * 6/1952 White ..... 451/469
3,058,269 * 10/1962 Block ..... 451/469
3,879,903 * 4/1975 Belanger ..... 451/469
4,080,714 * 3/1978 Emerson ..... 451/466
4,183,183 * 1/1980 Belnager ..... 451/469
4,882,879 * 11/1989 Warner et al. ..... 451/466
5,157,874 * 10/1992 Peng ..... 451/469

* cited by examiner

*Primary Examiner*—M. Rachuba
(74) *Attorney, Agent, or Firm*—Henry M. Feiereisen

(57) ABSTRACT

A sanding brush assembly, includes a metallic base body formed with a plurality of grooves in spaced-apart disposition about its circumference or formed on its end face. Detachably received in form-fitting or force-fitting engagement in each of the grooves is a clamping element which supports a strip brush carrying an array of bristles. Disposed between successive strip brushes and supported by the strip brushes are respective sanding segments, whereby each sanding segment is mounted together with the associated clamping element of the strip brush by a flexible footing in the pertaining groove.

18 Claims, 4 Drawing Sheets

SANDING BRUSH ASSEMBLY

CROSS-REFERENCES TO RELATED APPLICATIONS

This application claims the priority of German Patent Application Serial No. 298 04 936.8, filed Mar. 19, 1998.

BACKGROUND OF THE INVENTION

The present invention relates, in general, to a sanding brush assembly, and more particularly to a sanding brush assembly of a type having a metallic base body formed about its circumference or on its end face with grooves spaced at an angular distance from one another for detachably receiving in form-fitting or force-fitting engagement clamping elements of strip brushes, with sanding segments being secured to the base body between the strip brushes and supported by the strip brushes.

These types of sanding brush assemblies are also known as rotary brushes and can be used in sanding machines for sanding, dusting, cleaning, polishing and structuring of wood, metal, plastics or the like. The base body has a bore for placement on a sanding shaft, with the strip brushes containing an array of bristles made, for example, of horsehair, wire, abrasive grain, fiber or other like material.

The sanding segments form the sanding means and rest upon the strip brushes trailing in direction of rotation of the base body, thereby realizing also a sanding action of uneven or profiled workpieces. These sanding segments are subject to wear so that the sanding action deteriorates after a certain sanding operation. In conventional sanding brushes, the sanding segments extend into the interior of the base body, thereby forming a reserve which is used to compensate progressive wear of the sanding segments. This, however, requires the operator to, for example, loosen screw fasteners in order to pull out the sanding segments by a certain length. Thus, the readjustment of the sanding segments becomes rather cumbersome. Moreover, a relatively great length of sanding segments remains as residue, when further compensation of wear is no longer possible. This length is defined as the distance of the outer edges of the strip brush from the outer surface or end face of the base body.

SUMMARY OF THE INVENTION

It is thus an object of the present invention to provide an improved sanding brush assembly, obviating the afore-stated drawbacks.

In particular, it is an object of the present invention to provide an improved sanding brush assembly which is so configured as to significantly reduce the amount of waste, thereby increasing the overall efficiency.

It is still another object of the present invention to provide an improved sanding brush assembly which is so configured as to allow attachment of a greater number of sanding segments.

These objects, and others which will become apparent hereinafter, are attained in accordance with the present invention by securing each of the sanding segments to a flexible footing whereby the flexible footing of the sanding segment is clamped together with the clamping element of the strip brushes in the groove of the base body.

In accordance with the present invention, the base body is thus freed from direct attachment of the sanding segments. The flexible footing is so configured that the dimension of the attached sanding segment is substantially smaller than the wasted residue experienced in conventional sanding brushes and no longer suitable for use. As the flexible footing is mounted together with the strip brush in the groove, the need for separate fasteners to secure the sanding segments is eliminated. Replacement of sanding segments can thus be carried out in an extremely short period as the grooves and the clamping elements of the strip brushes are designed for a positive or form-fitting engagement. This can, for example, be realized by grooves of dovetail cross section.

Suitably, the attachment between the flexible footing and the sanding segment is realized outside the base body. As sanding brushes are operated at fairly high speed, the sanding segments are prevented from detachment from the grooves when exposed to centrifugal forces, by configuring the footing in such a manner that at least the area clamped in the groove has an angular or U shaped configuration and encompasses the clamping element.

According to another feature of the present invention, the bottoms of the grooves extend at least along two different circles, when, according to one configuration of the sanding brush assembly, the strip brushes are attached about the circumference of the base body, whereby the bottoms of the grooves are disposed in alternating distance to the axis of rotation of the sanding disk, or at least in two different planes when, according to another configuration of the sanding brush assembly, the strip brushes are attached on the end face of the base body, whereby then the bottoms of the grooves are disposed in alternating distance to the end face. Thus, as grooves are provided of at least two different depths, the use of the sanding segments is further optimized because the sanding segments can first be placed in those grooves whose bottoms are at a greatest distance to the perimeter or end face of the base body. After worn out to a certain extent, the sanding segments can then be repositioned into those grooves whose bottoms are at a smaller distance to the perimeter or end face of the base body. Thus, the sanding segments can be used up almost completely.

Suitably, the grooves are disposed in the base body according to a pattern. It is, for example, advantageous to arrange the grooves of varying depths in alternating relationship because it allows to shorten the angular distances between the grooves compared to conventional designs. Thus, the number of strip brushes and the number of sanding segments may be increased about the circumference or end face of the base body, thereby realizing a significantly improved sanding result. It is possible, to increase the number of strip brushes and sanding segments by about 40%.

Moreover, in the embodiment of the sanding brush assembly with strip brushes and sanding segments attached at the end face, the attachment of the strip brushes and the sanding segments to the base body may be realized in a star-shaped manner.

According to another feature of the present invention, each flexible footing has a section projecting beyond the perimeter or end face of the base body, with the outwardly projecting section being of arcuated configuration. The sanding segment is then so shaped as to conform to the shape of the arcuate section. While the deformability of the strip brushes is limited, the sanding segments are so configured as to deform to a greater extent. In this manner, the range of application of the sanding brush is expanded as the risk of damage of the workpiece being ground is significantly reduced, and wear of the sanding segment is decreased as a result of the diminished impact force upon contact with the workpiece being ground. The arcuate section may have any desired curvature or curved pattern. Preferred however is a configuration in which the outer edges are positioned at a greater distance to the associated strip brush than the mid-region. Regardless of the configuration of the sanding brush, the sanding segments are provided at least in the outer zone distal to the flexible footing with longitudinal indentations.

A sanding brush assembly according to the present invention is also utilized for handling profiled bars of varying cross sections, whereby the design of the strip brushes and the sanding segments depends on the cross sections of the profiled bars. Advantageously, the flexible footing extends into the area of the outer free edge of the pertaining strip brush, with the sanding segment being secured to the outer free edge of the flexible footing. As in this configuration, the external contour of the strip brush and the matching contour of the sanding segment are suited to the cross section of a profiled bar, it is proposed in accordance with the present invention to provide a support pad between the array of bristles of the strip brush and the flexible footing, whereby the support pad is preferably secured to the array of bristles. Thus, the support pad is positioned, when viewed in circumferential direction of the sanding brush, in front of the strip brush. This enhances the sanding action, as the support pad is not deformed as strongly as the strip brush.

According to another feature of the present invention, the support pad is made of cellular rubber or similar elastically deformable material. Regardless of the configuration of the sanding brush, the sanding segments and the strip brushes may advantageously be designed as profiled elements to suit them to varying cross sections of the objects being treated.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
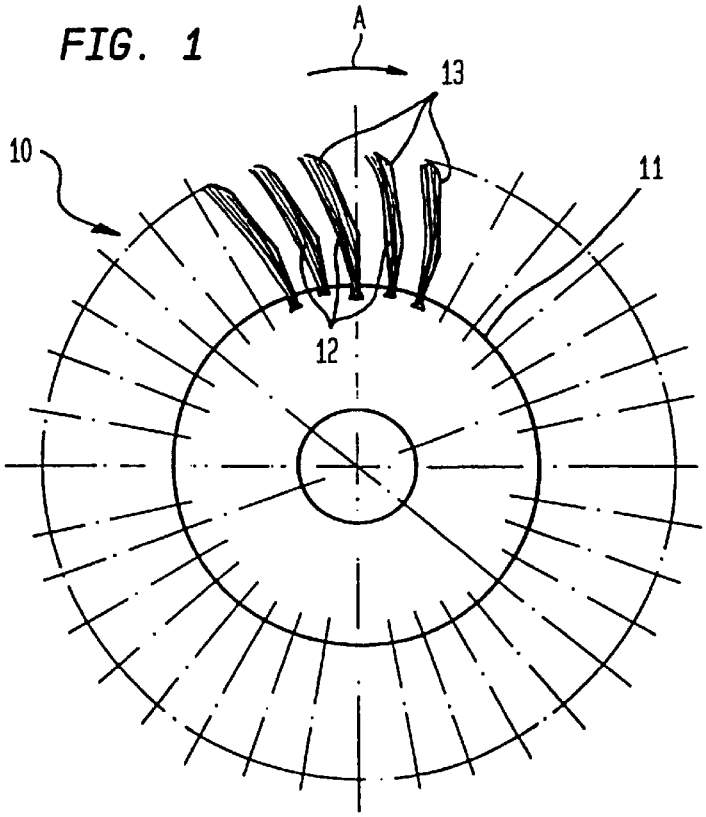
FIG. 1 is a schematic illustration of one embodiment of a sanding brush assembly according to the present invention.

Throughout all the Figures, same or corresponding elements are generally indicated by same reference numerals.

Figure 2:
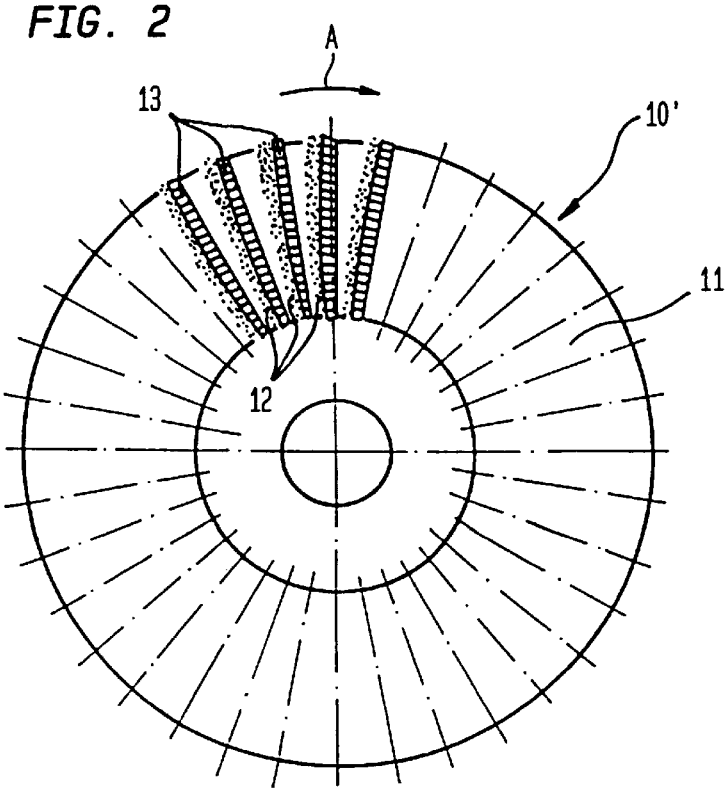
FIG. 2 is a schematic illustration of another embodiment of a sanding brush assembly according to the present invention.

Turning now to the drawing, and in particular to FIG. 1, there is shown a schematic illustration of one embodiment of a sanding brush assembly according to the present invention, generally designated by reference numeral 10 and essentially including a metallic base body 11, a plurality of strip brushes 12 which are spaced about the perimeter of the base body 11, and a like number of sanding segments 13 which are disposed between the strip brushes 12. Thus, in a 16 direction of rotation of the sanding brush assembly 10, as indicated by arrow A, the strip brushes 12 trail the sanding segments 13 and thus form a support for the sanding segments 13. FIG. 2 shows another embodiment of a sanding brush assembly 10' which differs from the sanding brush assembly 10 of FIG. 1 merely by the disposition of the strip brushes 12 and sanding segments 13 on one end face of the base body 11. Thus, as a comparison of FIGS. 1 and 2 shows, the outside diameter of the base body 11 of the sanding brush assembly 10' is significantly greater than the outside diameter of the base body 11 of the sanding brush assembly 10. FIGS. 1 and 2 also show that the outer free ends of the sanding segments 13 slightly extend beyond the ends of the strip brushes 12.

Figure 3:
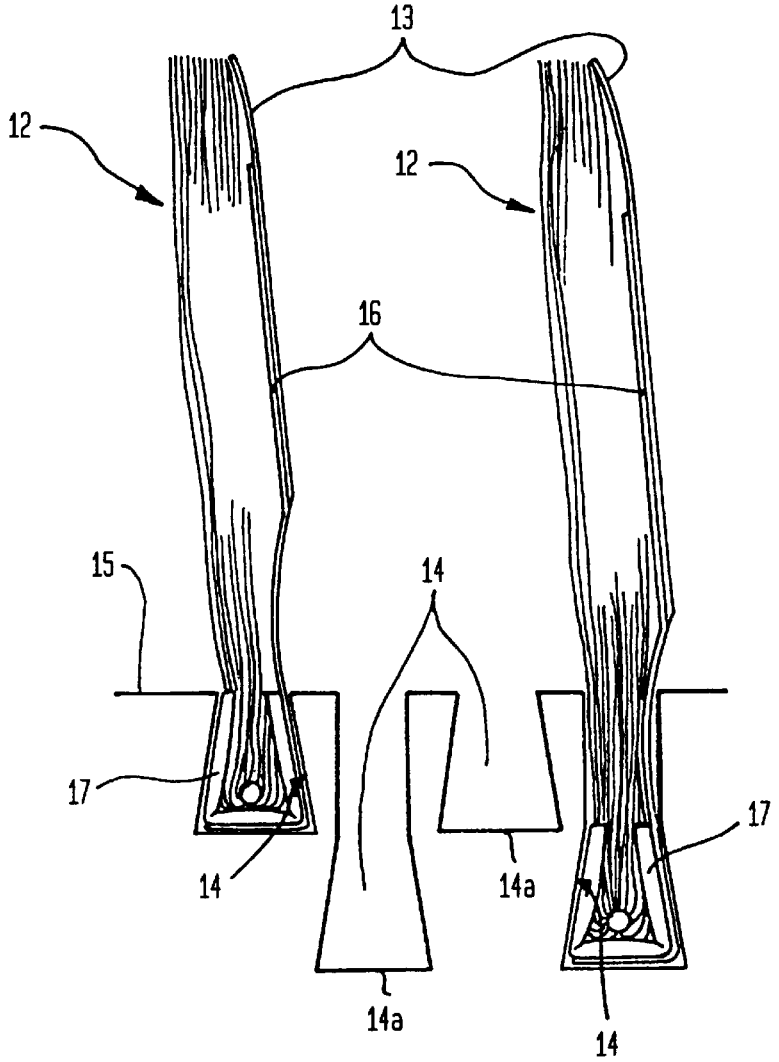
FIG. 3 is a cutaway view, in developed illustration, of grooves for receiving strip brushes and sanding segments.

Turning now to FIG. 3, there is shown a schematic illustration of an attachment of the strip brushes 12 and the sanding segments 13 in the base body 11 of the sanding brush assemblies 10, 10'. In the embodiment of FIG. 1, the base body 11 of the sanding brush assembly 10 is formed with grooves 14 spaced about the perimeter and extending across the entire width of the base body 11. In the embodiment of FIG. 2, the grooves 14 are formed in one annular end face and extend from the end face. Reference numeral 15 denotes in FIG. 3 a surface which may represent the circumferential surface of the base body 11 of the sanding brush assembly 10 or the annular end face of the base body 11 of the sanding brush assembly 10'.

The grooves 14 have two different depths and are arranged in alternating disposition so that the bottoms **14*a* of the grooves 14 of the sanding brush assembly 10 extend along two different diameters with respect to the circumferential surface 15, while the bottoms 14*a* of the grooves 14 of the sanding brush assembly 10' extend in two planes with respect to the annular end face 15. The depth of the grooves 14 with greater distance of the bottoms 14*a* to the circumferential surface or end face 15 is about double the depth of the grooves 14 of smaller distance. Persons skilled in the art will understand that the arrangement of grooves with two different depths in the base body 11** is shown by way of example only. It is certainly within the scope of the present invention, to provide an arrangement of grooves of more than two different depths.

As shown in FIG. 3, the grooves 14 of smaller depth have a dovetail configuration, while the grooves 14 of greater depth have a first part of tetragonal configuration which is followed by a second part of dovetail configuration. Each of the strip brushes 12 is received in a clamping element 17 which is inserted in the associated groove 14 and conforms to the shape thereof so as to realize a form-fitting engagement of the strip brushes 12 in the grooves 14. A positive engagement may also be realized by T-shaped grooves.

The attachment of the sanding segments 13 and the strip brushes 12 in the grooves 14 is identical for each sanding segment and strip brush so that their attachment will hereinafter be described in detail with reference to one exemplified sanding segment 13 and strip brush 12.

Figure 4:
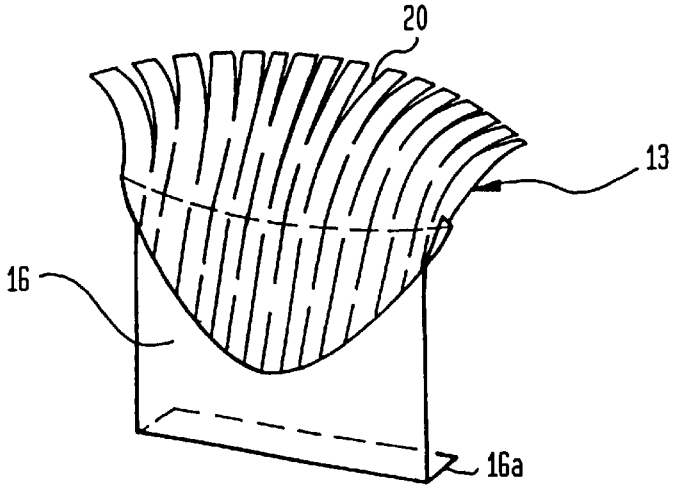
FIG. 4 is a perspective view of a sanding segment attached to an elastic footing.

As shown in particular in FIG. 4, the sanding segment 13 is secured, preferably by gluing, outside the base body 11 to a flexible footing 16 which has an angled lower end **16*a* distal to the sanding segment 13. In the area distant to the flexible footing 16, the sanding segment 13 is formed with longitudinal indentations 20. The footing 16 is insertable with its lower end 16*a* into the dovetailed section of the groove 14 of greater depth such as to encompass the clamping element 17 which holds the bristles of the strip brush 12 together (cf. FIG. 3). When the strip brush 12 and the sanding segment 13 wears off to a certain extent following a sanding operation, the strip brush 12 and the sanding segment 13 can then merely be removed from the groove 14 of greater depth and inserted into the groove 14** of smaller depth to thereby re-establish the full sanding action.

Persons skilled in the art will appreciate that the lower end 16*a* of the flexible footing 16 may also be of U-shaped configuration.

The area of the flexible footing 16, projecting out of the footing body 11, forms the attachment zone for the sanding segment 13 and is so arched with respect to the strip brush 12 that the outer edge of the sanding segment 13 extends at a greater distance to the strip brush 12, which trails the sanding segment 13 in direction of rotation A, than a mid-region thereof. However, it will be understood that the curvature may also be designed in opposite direction. The arched area of the footing 16 realizes also a deformation of the attached sanding segment 13. This design is advantageous during sanding as the risk for damage of the workpiece being ground is significantly reduced. FIG. 4 also shows that the free edge of the flexible footing 16 extends along an arc directed toward the base body 11.

Figure 5:
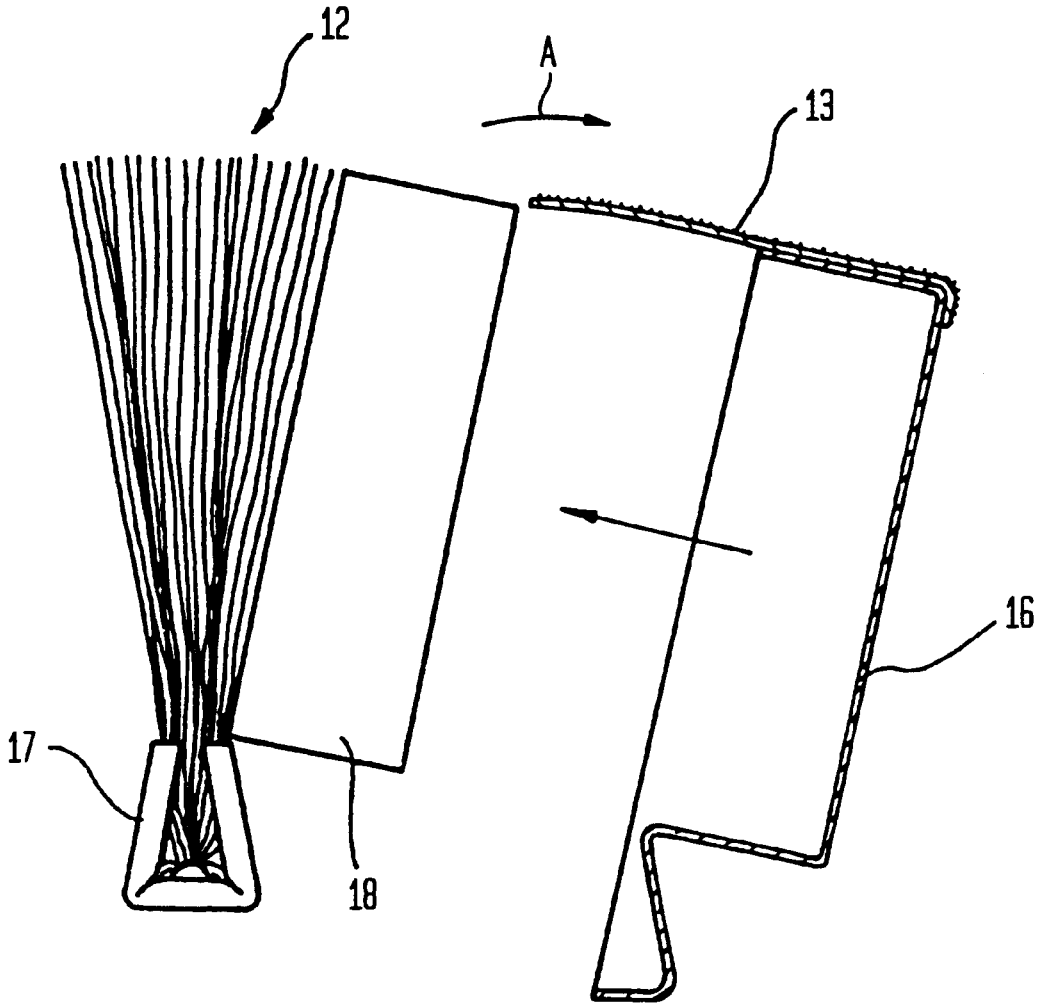
FIG. 5 is a fragmentary, partially sectional view, in exploded illustration, of still another embodiment of a sanding brush assembly according to the present invention.

Turning now to FIG. 5, there is shown a fragmentary, partially sectional view, in exploded illustration, of still another embodiment of a sanding brush assembly according to the present invention, generally designated by reference numeral 10". Again, it is noted that same reference numerals are used for same elements as described in the preceding description. The sanding brush assembly 10" is particularly suitable for working on profiled bars, and includes a strip brush 12 in the form of bristles restrained in a clamping element 17. The outer contour of the strip brush 12 and thus also the contour of the sanding segment 13 is suited to the cross sectional configuration of profiled bars to be handled. The contour of the strip brush 12 may be stepped, arched or the like.

Disposed between the flexible footing 16 and the array of bristles of the strip brush 12 is a support pad 18 which is made of cellular rubber. The support pad 18 extends over the entire length of the bristles of the strip brush 12. In the non-limiting example of FIG. 5, the support pad 18 is glued to the strip brush 12. In the assembled state, the flexible footing 16 encompasses the support pad 18 and is so shaped that the upper free edge of the footing 16 reaches into the area of the free edge of the bristles and lap over the support pad 18, with the sanding segment 13 being mounted to the overlapping edge of the footing 16. Also the lateral walls of the support pad 18 are enveloped by the footing 16 which is a formed body conforming to the shape of the support pad 18.

In direction of rotation of the sanding brush assembly 10", indicated by arrow A, the support pad 18 is positioned in front of the bristles of the strip brush 12.

Also in this embodiment, the consumption of material for the sanding segments 13 is significantly reduced compared to conventional constructions. Moreover, the sanding segments 13 can almost entirely be used up as a consequence of the different depths of the grooves 14.

Figure 6:
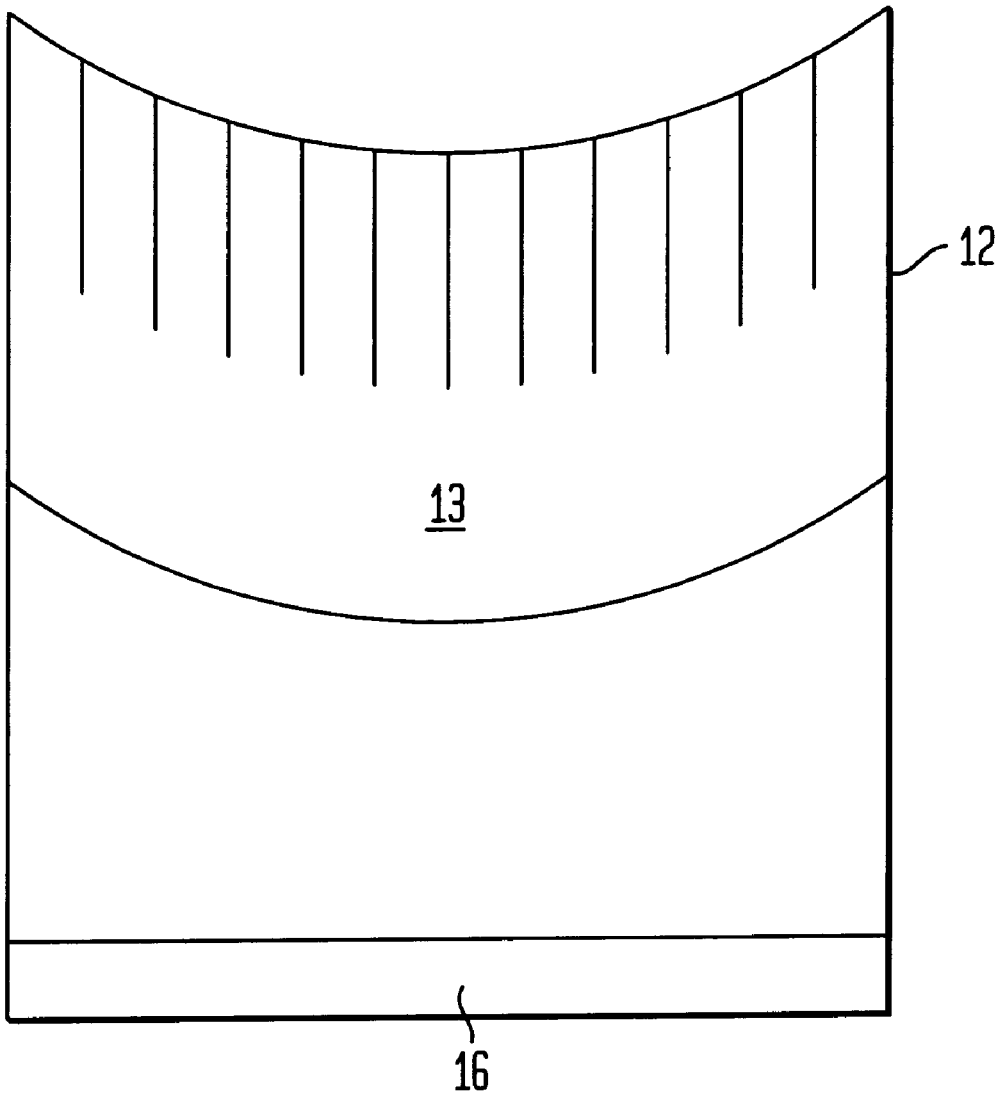
FIG. 6 is a simplified, schematic illustration of an exemplified sanding brush assembly with strip brush and sanding segments as profiled elements.

FIG. 6 shows, by way of example only, sanding segments 13 and strip brushes 12 as profiled elements, whereby the sanding segments 13 and the strip brushes 12 have, for example, a curved configuration to suit to a complementary curved object being treated. Of course, the sanding segments 13 and the strip brushes 12 may have different configurations to suit respective cross sections of the objects being treated.

While the invention has been illustrated and described as embodied in a sanding brush assembly, it is not intended to be limited to the details shown since various modifications and structural changes may be made without departing in any way from the spirit of the present invention.

What is claimed is:

1. A sanding brush assembly, comprising:

a metallic base body formed with a plurality of grooves in spaced-apart disposition;

a plurality of clamping elements, each of the clamping elements supporting a strip brush and detachably received in a corresponding one of the grooves, whereby the clamping elements and the grooves are placed into one-to-one correspondence;

a plurality of sanding segments disposed between successive strip brushes and supported by the strip brushes; and attachment means for securing the sanding segments in the grooves, said attachment means including a plurality of flexible footings, each of the footings supporting a corresponding one of the sanding segments clamping and securing the sanding segment together with the element for the strip brush in the pertaining groove.

2. The sanding brush assembly of claim 1 wherein the grooves are spaced at an angular distance about a circumference of the base body.

3. The sanding brush assembly of claim 1 wherein the grooves are spaced at an angular distance on an end face of the base body.

4. The sanding brush assembly of claim 1 wherein the clamping element is received in the groove by way of positive engagement.

5. The sanding brush assembly of claim 1 wherein the footing is connected to the sanding segment at a location outside the base body.

6. The sanding brush assembly of claim 1 wherein the flexible footing has at least one area having a configuration which is selected from the group consisting of U shape and angular shape, and clamped in the groove, said area encompassing the clamping element.

7. The sanding brush assembly of claim 1 wherein each of the grooves is defined by a groove bottom, said grooves being so disposed that the groove bottoms extend about at least two different circles or planes.

8. The sanding brush assembly of claim 7 wherein the grooves have different depths and are positioned in alternating relationship in the base body.

9. The sanding brush assembly of claim 7 wherein the base body has an annular end face, said grooves for receiving the strip brushes and the sanding segments being disposed in the base body in a star-shaped manner.

10. The sanding brush assembly of claim 1 wherein the flexible footing has an area projecting outwards with respect to the base body, said area having an arc-shaped configuration.

11. The sanding brush assembly of claim 10 wherein the outwardly projecting area of the footing is so arcuated as to define outer edges and a mid-region, said outer edges of the footing being spaced to the trailing strip brush, when viewed in direction of rotation of the base body, at a greater distance than the mid-region.

12. The sanding brush assembly of claim 1 wherein the strip brush includes an array of bristles, and further comprising a support pad positioned between the array of bristles and the flexible footing.

13. The sanding brush assembly of claim 12 wherein the support pad is secured to the array of bristles.

14. The sanding brush assembly of claim 12 wherein the strip brush extends out of the base body and terminates in an outer free edge, said flexible footing extending into the area of the outer free edge of the strip brush and defining an outer free edge, with the sanding segment being secured to the outer free edge of the flexible footing.

15. The sanding brush assembly of claim 14 wherein the support pad has an end face distal to the clamping element, said outer free edge of the flexible footing encompassing said end face of the support pad.

16. The sanding brush assembly of claim 12 wherein the support pad is made of cellular rubber.

17. The sanding brush assembly of claim 1 wherein the sanding segments and the strip brushes are designed as profiled elements.

18. The sanding brush assembly of claim 1 wherein the clamping element is received in the groove by way of interference fit.

* * * * *